United States Patent [19]

McKee et al.

[11] Patent Number: 4,716,501

[45] Date of Patent: Dec. 29, 1987

[54] INDICATOR LIGHT ASSEMBLY WITH FLUORESCENT LENS

[76] Inventors: John M. McKee, 3307 NW. 108 Dr., #15; Joseph V. Ranalletta, 3893 NW. 73 Terr., both of Coral Springs, Fla. 33065

[21] Appl. No.: 921,295

[22] Filed: Oct. 21, 1986

[51] Int. Cl.[4] ..... F21V 7/04

[52] U.S. Cl. ..... 362/31; 362/326; 362/331

[58] Field of Search ..... 362/30, 31, 326, 330, 362/331, 335, 336, 334, 311

[56] References Cited

U.S. PATENT DOCUMENTS

| | | | |
|---|---|---|---|
| 4,177,501 | 12/1979 | Karlin | 362/31 |
| 4,215,390 | 7/1980 | Brandt | 362/311 |
| 4,220,948 | 9/1980 | Trame | 340/378.2 |
| 4,238,524 | 12/1980 | LaLiberte et al. | 427/145 |
| 4,257,084 | 3/1981 | Reynolds | 362/31 |
| 4,323,951 | 4/1982 | Pasco | 362/31 |
| 4,329,378 | 5/1982 | Tarumi et al. | 427/157 |
| 4,408,803 | 10/1983 | Green et al. | 301/5.7 |

FOREIGN PATENT DOCUMENTS

| | | | |
|---|---|---|---|
| 7635 | 2/1980 | European Pat. Off. | 362/326 |
| 1167978 | 4/1964 | Fed. Rep. of Germany | 362/326 |
| 952388 | 3/1964 | United Kingdom | 362/31 |
| 1026596 | 4/1966 | United Kingdom . | |

OTHER PUBLICATIONS

Steven Ashley, "Razzle-Dazzle Plastic," *Popular Science,* Apr. 1986, pp. 100–101.

Mobay Chemical Corporation, "Provisional Information Sheet—LISA-Plastics," Publication No. KL 47.310e, Jan. 10, 1983.

*Primary Examiner*—James C. Yeung

*Attorney, Agent, or Firm*—Martin J. McKinley; Joseph T. Downey; Mark P. Kahler

[57] ABSTRACT

A clear plastic lens contains a fluorescent dye. The lens is substantially parallelepiped in shape with two major opposed parallel surfaces and four sides. Three of the sides are reflecting sides. Each reflecting side has two flat transparent surfaces positioned at angles of 135 degrees relative to the opposed parallel surfaces. The fourth side is a transmitting side that has one flat transparent surface perpendicular to the opposed parallel surfaces. Light enters the lens through an opposed parallel surface, is absorbed by the fluorescent dye, and is emitted a short time later. The emitted light is reflected at the reflecting sides and opposed surfaces, and redirected towards the transmitting side where it passes into the environment as a collimated beam.

In another embodiment, the transmitting side is at an oblique angle relative to the opposed parallel surfaces and has a plurality of small steps. Each step has two surfaces, one perpendicular and one parallel to the opposed parallel surfaces. The emitted light passes into the environment through the first surfaces of the steps.

The complete assembly includes the lens positioned adjacent a circuit board. An opening in the board permits light to enter the lens from a lamp which is soldered to the opposite side of the board over the opening.

5 Claims, 7 Drawing Figures

–PRIOR ART–

INDICATOR LIGHT ASSEMBLY WITH FLUORESCENT LENS

BACKGROUND OF THE INVENTION

This invention relates to the field of indicator light assemblies and more particularly to such assemblies that include lenses that contain fluorescent dyes.

To indicate equipment status, visual feedback is often provided in the form of a light source or "indicator light" which is activated when a predetermined equipment condition occurs. A lens is typically placed in front of the indicator light to soften the intensity of the light, change its color, or to disperse, focus or redirect the light.

In the design of electronic equipment, the general trend has been to reduce the overall size of the equipment. This is particularly true in the selective call radio paging receiver market where recently designed "pagers" are now available that can be carried in a shirt pocket. Such designs typically include a rectangular parallelepiped plastic housing that contains a single printed circuit board with appropriately attached electronic components. The housing is typically not much wider than the thickness of the printed circuit board and components. Therefore, if an indicator light assembly is to be installed in such a pager, a low profile assembly is required.

Although older paging receiver designs convey the received message to the user immediately upon receipt, recently developed paging receiver designs store a received message in the pager for later retrieval by the user. Therefore, it becomes necessary to inform the user that a message has been received. This is typically accomplished by sounding an alert tone, flashing a light, activating a vibrator, or, in the case of a digital display pager, causing a predetermined symbol to appear in the paging receiver's display. If a visual indication is desired, the current drain of the light source becomes critical because paging receivers typically have a very limited battery capacity. Therefore, to reduce battery drain while maintaining the output light intensity at an acceptable level, it would be desirable if the light from the light source could be collimated and directed in the general direction of the user's eyes.

In the previously described typical paging receiver design where a printed circuit board is enclosed in a plastic parallelepiped housing, the pager is usually worn such that the printed circuit board is parallel to the body; for example, when the pager is worn on a belt or carried in a shirt pocket, the printed circuit board is usually positioned parallel to the body. Therefore, if a light source were attached to the printed circuit board, the general direction of the light emitted from the source would be perpendicular to the board and, consequently, away from the user's eyes. Therefore, it would be desirable if a lens could be placed in front of the light source that would redirect the light in the general direction of the user's eyes, i.e., parallel to the printed circuit board.

In summary, there is a need for a low profile indicator light assembly that utilizes a low power light source attached to a printed circuit board. This low profile indicator light assembly should collimate the light emitted from the light source and redirect it in a direction parallel to the printed circuit board. In addition, it would be desirable if the light emitted from the assembly were of one color.

A prior art indicator light assembly is illustrated in FIG. 1. This assembly is used in plug-in modules manufactured by the Tektronixs Corporation for their 7000 series oscilloscopes. Referring to FIG. 1, a light source 100 emits light in a variety of directions. Of particular significance is the light emitted in the vertical direction; for example, light ray 102. Translucent plastic push buttons 104, 106 and 108 partially project out the front (to the left) of a chassis 110. In the figure, push button 106 is shown in its depressed position. An appropriate mechanism (not illustrated) latches the depressed push button in its depressed (right most) position while releasing the previously depressed push button to return to its undepressed (left most) position. Thus, only one push button can be held depressed at any one time. An appropriate multi-pole electrical switch assembly (not illustrated) is connected to the various push buttons to selectively activate corresponding circuits in the module. The construction of the mechanical mechanism and the multi-pole switch are unimportant for the purposes of this discussion and only the optical properties of the assembly will be discussed in detail.

When one of the push buttons is depressed, for example push button 106, light ray 102 strikes the bottom surface **106*a* of the push button at a 90 degree angle and is transmitted through the surface and upwards through the plastic without any change in its direction. Diagonal surface 106*b* of push button 106 is positioned at an angle of 45 degrees relative to bottom surface 106*a*. According to the principles of total internal reflection, when light ray 102 encounters diagonal surface 106*b*, it is reflected 90 degrees to the left. Light ray 102 then travels the length of push button 106 whereupon it strikes front surface 106*c*** at a 90 degree angle and is transmitted through the surface, whereupon it becomes visible to the user.

If a different push button is depressed, for example push button 104, switch button 106 is released and moves to the left to its undepressed position. Switch button 104 then moves to the right whereupon it will intercept light ray 102 which will be reflected by diagonal surface **104*b* and transmitted through front surface 104*c***.

SUMMARY OF THE INVENTION

Briefly, the invention is an indicator light assembly that includes translucent block that has an index of refraction greater than that of the environment. The translucent block includes a fluorescent material and has two opposed and substantially parallel surfaces connected by a plurality of sides. One of these sides includes an indicating surface that is positioned at an angle relative to the opposed surfaces whereby internal light travelling substantially parallel to the opposed surfaces is transmitted through the indicating surface. Another side includes first and second reflecting surfaces positioned at angles relative to the opposed surfaces whereby internal light travelling substantially parallel to the opposed surfaces is reflected back into the block.

In another embodiment, the indicator light assembly also includes a translucent block having an index of refraction greater than that of the environment. A fluorescent material is also included in the block along with two opposed substantially parallel surfaces that are connected by a plurality of sides. In this embodiment, one of the sides includes a plurality of steps with each step having a first surface substantially perpendicular to the opposed surfaces, and a second surface substantially parallel to the opposed surfaces. Internal light travelling substantially parallel to the opposed surfaces is transmitted through the first surfaces of the steps. As in the previously described embodiment, another of the sides includes first and second reflecting surfaces that are positioned at angles relative to the opposed surfaces whereby internal light travelling substantially parallel to the opposed surfaces is reflected back into the block In still another embodiment, a low profile indicator light assembly includes a substantially parallelepiped transparent block that has an index refraction greater than 1.5 and includes a fluorescent dye. The block has first and second opposed and substantially parallel surfaces connected by four sides. One of the sides includes a plurality of steps with each step having a first surface substantially perpendicular to the opposed surfaces and a second surface substantially parallel to the opposed surfaces. Internal light travelling substantially parallel to the opposed surfaces is transmitted through the first surfaces of the steps. Three of the sides include first and second reflecting surfaces wherein the first reflecting surface is positioned at an angle of substantially 135 degrees relative to the first opposed surface, and the second reflecting surface is positioned at an angle of substantially 135 degrees relative to the second opposed surface. Internal light travelling substantially parallel to the opposed surfaces is reflected back into the block.

DESCRIPTION of the PREFERRED EMBODIMENT

Figure 1:
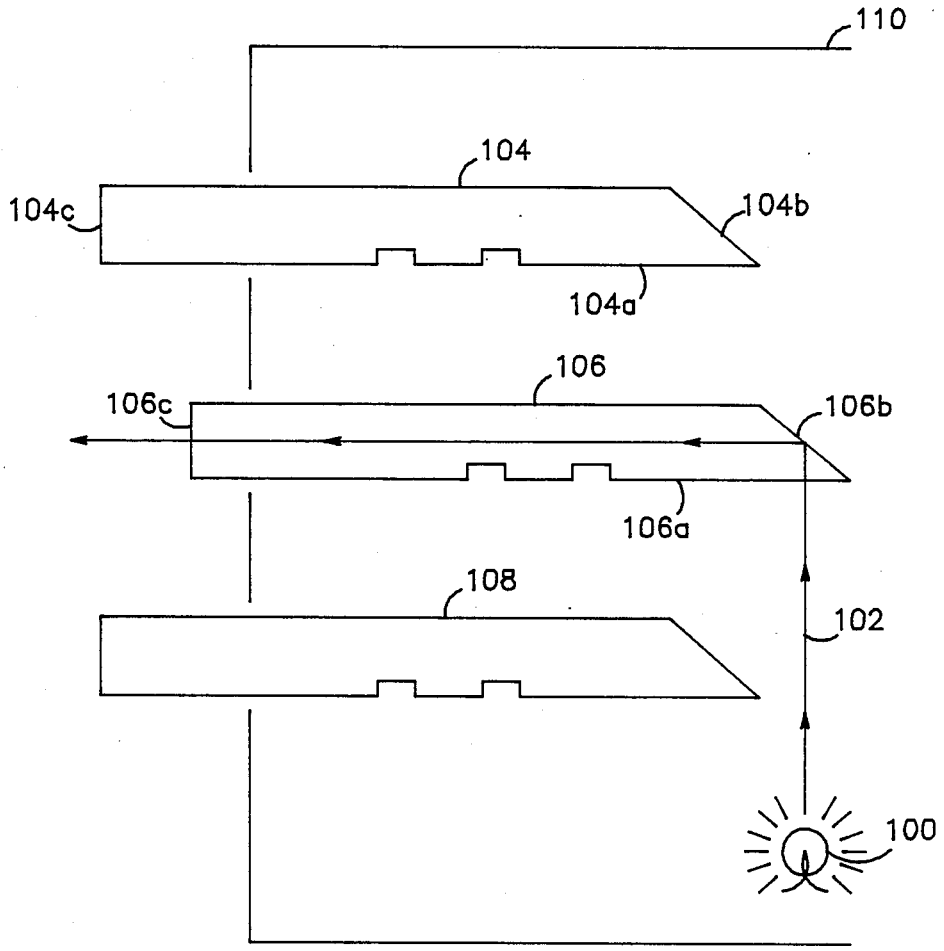
FIG. 1 is a plan view of a prior art indicator light assembly.
Figure 2:
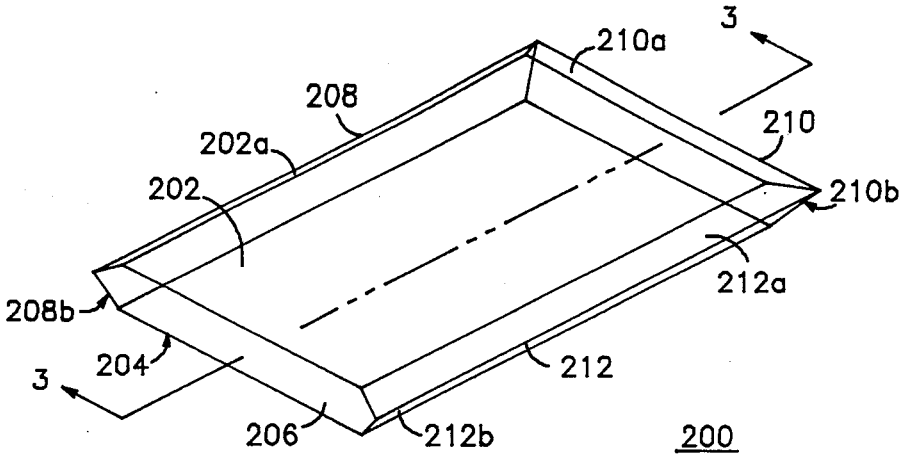
FIG. 2 is a perspective view of one embodiment of a novel indicator lens.
Figure 3:
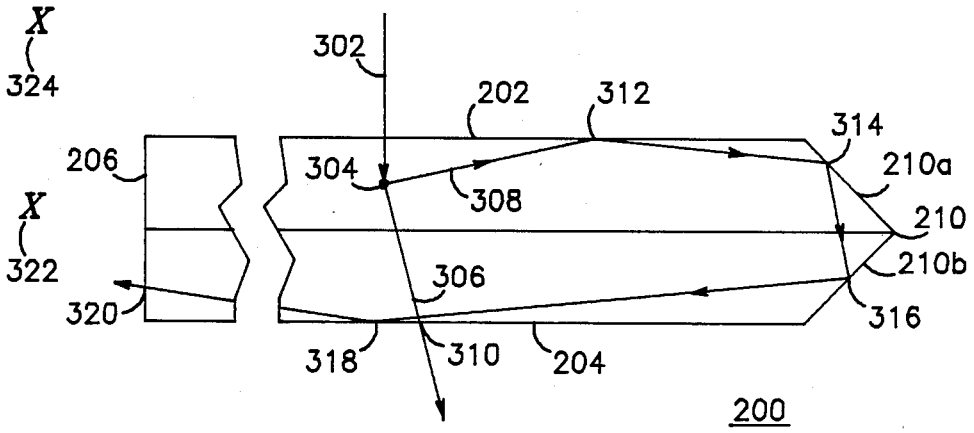
FIG. 3 is a sectional view of the embodiment of the indicator lens illustrated in FIG. 2 as seen along line 3—3.

In FIGS. 2 and 3, one embodiment of a fluorescent indicator lens 200 is illustrated. Referring to these figures, lens 200 is constructed from a block of translucent material that has two opposed and substantially parallel major surfaces 202 and 204 connected at their perimeters by four sides 206, 208, 210 and 212. Side 204 is an "indicating surface" which is positioned at a 90 degree angle relative to opposed surfaces 202 and 204. Sides 208, 210 and 212 each include first and second reflecting surfaces (respectively indicated by the subscripts "a" and "b"). The first reflecting surfaces, for example reflecting surface 210*a*, are positioned at an internal angle of 135 degrees relative to the upper opposed surface 202, while the second reflecting surfaces, for example 210*b*, are positioned at an internal angle of 135 degrees relative to lower opposed surface 204.

The block of translucent material that lens 200 is constructed from is preferable transparent polycarbonate, although other translucent materials may also be suitable. The block contains a fluorescent material, preferable a low-molecular weight polymer dyestuff. Sheets of various plastics containing such fluorescent dyestuffs are available from the Mobay Chemical Corporation and are know as "Lisa" plastics. "Lisa" is an abbreviation for the German word "lichtsammeln", which means "light collecting". Lisa plastics absorb ambient light and emit it as long wavelength fluorescent light.

The operation of lens 200 is illustrated in FIG. 3. Referring to this figure, a light ray 302 originates from some point in the environment and enters the translucent block whereupon it is absorbed by the fluorescent dyestuff, for example dyestuff molecule 304. Approximately one nano-second after absorption, long wavelength light, for example rays 306 and 308, is emitted from the dyestuff.

According to the principle of Total Internal Reflection, if light is traveling in a media that has a higher index of refraction than that of the environment, and the light encounters a boundary between the media and the environment, the light will be totally reflected at that boundary if the angle of incidence exceeds the "critical angle". The angle of incidence and the critical angle "CA" are measured from a line drawn perpendicular to the boundary surface. The critical angle is calculated from the following formula: $\sin CA = Ne/Nm$, wherein Ne and Nm are the indexes of refraction of the environment (typically air, which has an index of refraction of approximately 1) and the media in which the light is traveling (in FIG. 3, lens 200).

Thus, at point 310, light ray 306 strikes lower opposed surface 204 at an angle of incidence less than the critical angle and it passes through the surface and into the environment. At point 312, however, light ray 308 strikes upper opposed surface 202 at an angle of incidence that exceeds the critical angle and it is totally reflected towards point 314 of reflecting surface 210*a*. At point 314, and also at point 316 (on reflecting surface 210*b*) and point 318 (on lower opposed surface 204), light ray 308 strikes the surfaces at angles of incidence that exceed the critical angle and the light ray is totally reflected. After being reflected at point 318, light ray 308 strikes point 320 on indicating surface 206 at an angle on incidence that is less than the critical angle and it is transmitted through the indicating surface whereupon it is visible to an observer.

Approximately 75 percent of the light that is emitted by the fluorescent dyestuff travels in a direction that is substantially parallel to opposed surfaces 202 and 204. In other words, 75 percent of the light will be internally reflected (in a manner similar to light ray 308) by sides 208, 210 and 212, and by opposed surfaces 202 and 204, such that it is transmitted into the environment through indicating surface 206. It should be evident from FIG. 3, that the light being transmitted through indicating surface 206 has been collimated and is traveling in a direction substantially parallel to opposed surfaces 202 and 204. Thus, an observer positioned at point 322 will be able to view the light transmitted through indicating surface 206, but an observer positioned "off-axis" at point 324 will not be able to see the light.

Although FIG. 2 illustrates a lens wherein the shape of opposed surfaces 202 and 204 is rectangular, other shapes are also possible. For example, opposed surfaces 202 and 204 could be shaped in the form of any polygon or any shape having acurate edges. A simple example of the later would be a circle. In the circle example, the indicating side (206 in the rectangular embodiment) would sweep "x" degrees of arc of the perimeter of the circle, while the reflecting sides (208, 210 and 212 in the rectangular embodiment) would cover the remaining "360-x" degrees of arc. A more practical example, however, would be a shape having the end points of a partial circle joined by a straight line segment. The sides of such a shape would include a flat indicating side and an acurate reflecting side.

Although it is preferred that reflecting sides 208, 210 and 212 include first and second reflecting surfaces positioned at an angle of 135 degrees relative to opposed surfaces 202 or 204, some variation from this ideal angle is permissible. Also, other combinations and configurations of more than two reflecting surfaces per side can be envisioned that will reflect light traveling substantially parallel to opposed surfaces 202 and 204 back into the translucent block of material. Although more complicated to manufacture, reflecting sides 208, 210 and 212 could each include one flat surface positioned perpendicular to opposed surfaces 202 and 204 and coated with a well know reflective coating, such as aluminum.

The index of refraction of the block material is an important consideration. When the reflecting surfaces are positioned 135 degrees relative to the opposed surfaces, internal light traveling parallel to the opposed surfaces strikes the reflecting surfaces at an angle of incidence of 45 degrees. When used in an air environment (Ne=1), the previously described equation for total internal reflection dictates that the index of refraction of the block must be approximately 1.5 or greater.

Although FIG. 2 also shows the preferred angle for the positioning of indicating surface 206 relative to opposed surfaces 202 and 204, other angles are also possible. For example, indicating surface 206 can be placed at any angle relative to opposed surfaces 202 and 204, as long as any internal light traveling substantially parallel to the opposed surfaces strikes the indicating surface at at an angle of incidence less than the critical angle. According to the principle of total internal reflection, if the angle of incidence is less than the critical angle, the internal light will be transmitted through the indicating surface as desired. To a first approximation, indicating surface 206 should be placed relative to opposed surfaces 202 and 204 at an angle of 90 degrees plus or minus the critical angle. Although 90 degrees is preferred, it may be desirable to slant the indicating surface such that it will be parallel and flush with a correspondingly slanted exterior surface of a housing in which lens 200 is installed.

Figure 4:
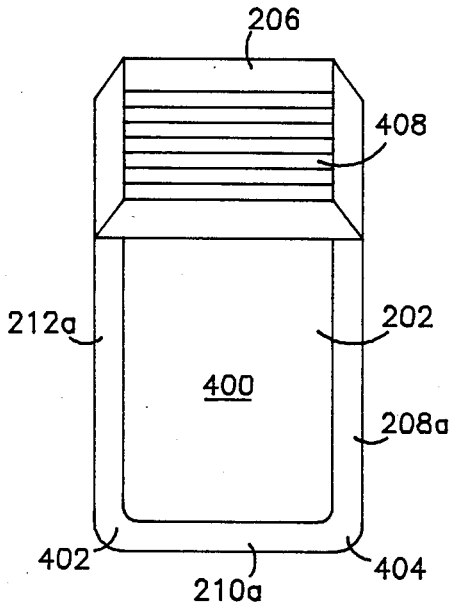
FIGS. 4, 5 and 6 are respectively top, bottom side and right side plan views of another embodiment of a novel indicator lens.
Figure 6:
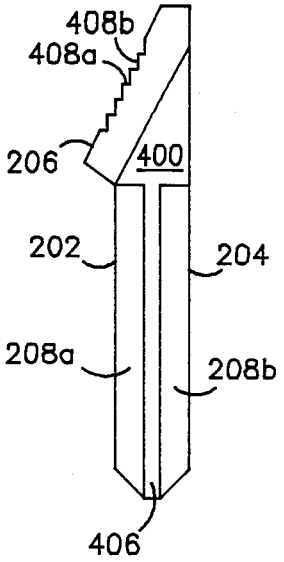
Figure 5:
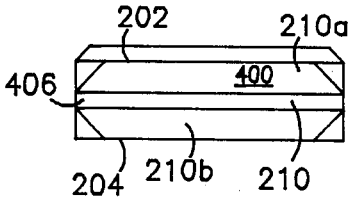
Figure 7:
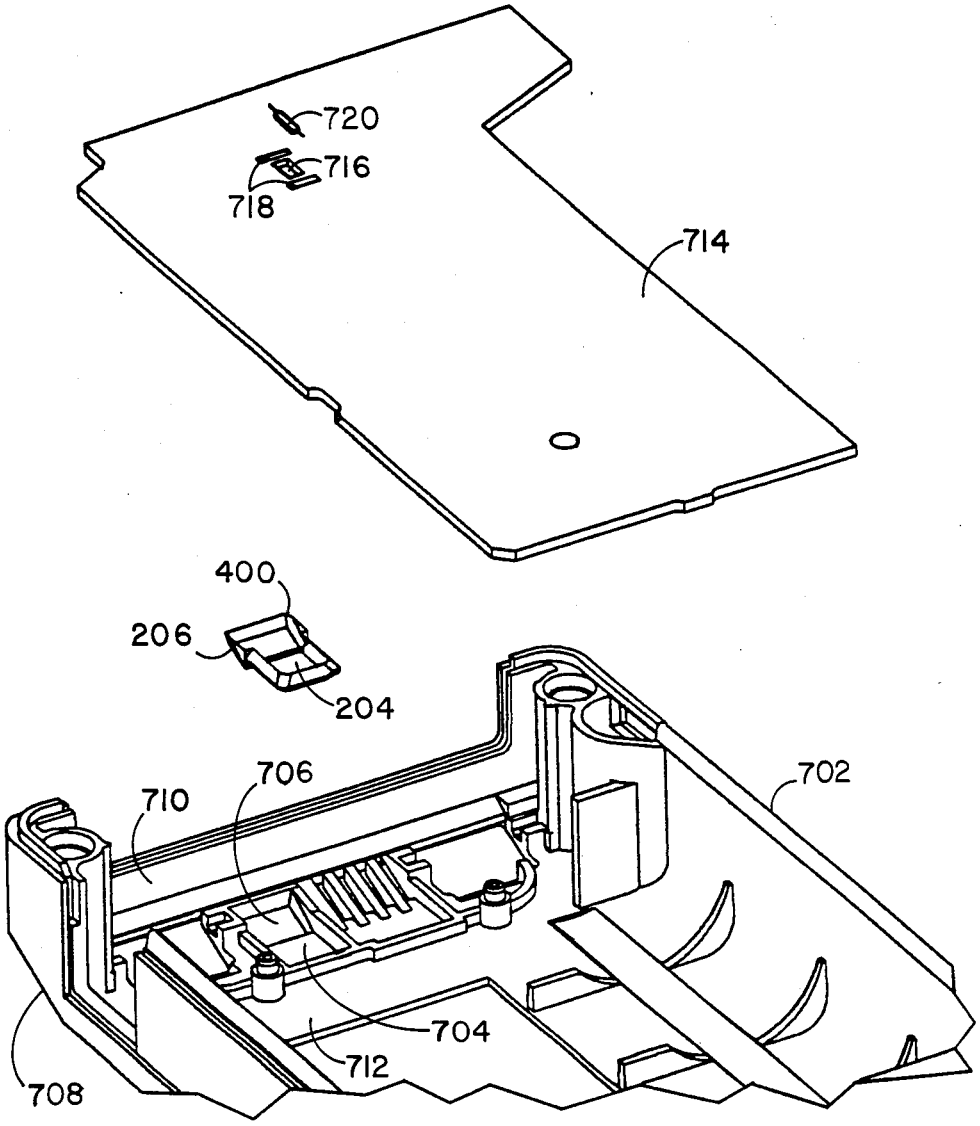
FIG. 7 is an exploded perspective view of a novel indicator light assembly that includes the lens illustrated in FIGS. 4 -6.

If the surface of the housing is slanted at such an angle that the lens indicating surface 206 cannot be positioned parallel to and flush with the outside surface of the housing without causing the indicating surface to undesirably become a reflecting surface (because light traveling substantially parallel to the opposed surfaces strikes the indicating surface at an angle of incidence less than the critical angle), then a second embodiment of the lens required. A top, bottom side and right side plan view of a second embodiment of an indicator lens 400 is illustrated respectively in FIGS. 4, 5 and 6. A perspective view of lens 400 is also illustrated in FIG. 7, as part of the complete indicator light assembly.

Referring to FIGS. 4–7, the second embodiment of the lens (lens 400) is found to have features in common with the first embodiment (lens 200, which is illustrated in FIGS. 2 and 3). For example, lens 400 may be constructed from the same translucent materials as lens 200 (including the fluorescent material), and it is also substantially parallelepiped in shape. Lens 400 has the two opposed major surfaces 202 and 204, and the three reflecting sides 208, 210 and 212 previously described and illustrated with regard to lens 200. As in the first embodiment, each of the sides 208, 210 and 212 has, respectively, two reflecting surfaces 208*a-b*, 210*a-b* and 212*a-b*. Unlike the first embodiment, however, lens 400 has rounded corners 402 and 404 and a thin flat surface 406 that connects each opposing pair of reflecting surfaces. Rounded corners 402 and 404, and thin flat surface 406 improve the manufacturability of lens 400, but have substantially no effect on its optical properties.

Although lens 400 also has an indicating surface 206, the major distinction between the two embodiments is that the indicating surface of lens 400 is positioned at an angle relative to opposed surfaces 202 and 204 such that internal light, which is traveling between and substantially parallel to the opposed surfaces, would be reflected by a flat indicating surface. As previously stated, it is often desirable to position indicating surface 206 at such an excessive angle so that it runs parallel to and sits flush with a correspondingly slanted outer surface of a housing. But, indicating surface 206 should transmit internal light into the environment so that the light will be visible to an observer, not reflect light back into the block of translucent material. Therefore, a plurality of small steps, for example 408, are located on indicating surface 206 wherein each step has a first surface, for example 408*a*, substantially perpendicular to opposed surfaces 202 and 204, and a second surface, for example 408*b*, substantially parallel to the opposed surfaces. Internal light, traveling between and substantially parallel to opposed surfaces 202 and 204, is transmitted through the first surface of each step, for example 408*a*, whereupon it becomes visible to an appropriately positioned observer. Preferably, each step should be small.

In the preferred embodiment, lens 400 is constructed from a polycarbonate Lisa polymer resin, such as Mobay Chemical Corporation's KLI-9400 Lisa polymer. The overall size of lens 400 is 328 mils long, by 204 mils wide, by 53 mils thick (between opposed surfaces 202 and 204). Indicating surface 206 is positioned at an angle of 22 degrees relative to lower opposed surface 204 and each first surface of each step is 5 mils wide and each second surface is 12 mils wide.

Although lenses 200 or 400 can be used in any light assembly, the preferred assembly is illustrated in FIG. 7. In particular, FIG. 7 illustrates an application that is pertinent to the design of lens 400. In other words, the housing in the figure has an exterior surface that is sloped at such an angle that the stepped indicating surface embodiment of the lens (lens 400) is required.

Referring to FIG. 7, a substantially parallelepiped housing 702 has a cavity 704 suitable for receiving lens 400. Located at the upper end of cavity 704 is an opening 706 suitable for receiving the indicating surface 206 of lens 400. The outside of housing 702 has exterior surface 708 positioned at an oblique angle relative to either the top side 710 or the front side 712 of the housing. When lens 400 is positioned in cavity 704, indicating surface 206 is visible from the outside of housing 702 and sits parallel to and flush with oblique exterior surface 708. To retain lens 400 in cavity 704, it is preferable that housing 702 and lens 400 be constructed of a polycarbonate material so that the lens can be sonically "staked" or "welded" into the housing.

A printed circuit board 714 is positioned behind lens 400 and its front surface preferably contacts opposed surface 204 of the lens. Circuit board 714 has an opening 716 which is centrally positioned over opposed surface 204. On the rear surface of circuit board 714 and on two opposite sides of opening 716 are solder pads 718 to which an axially leaded incandescent lamp 720 is soldered.

Because other electrical components are also soldered to the rear surface of circuit board 714, the positioning of lamp 720 on this rear surface does not result in any increase in the overall thickness of the circuit board and components. The only element that adds thickness to the assembly is the thickness of lens 400. However, lens 400 is only 53 mils thick. Thus, a very low profile indicator light assembly has been achieved that only increases the thickness of the existing electronic components contained in the housing by approximately 1/20th of an inch.

In operation, voltage is applied across solder pads 718 and lamp 720 is illuminated. Light from lamp 720 is projected through opening 716 and enters lens 400 through opposed surface 204. As previously described, this light is then absorbed by the fluorescent material in the lens and, a very short time later, emitted as longer wavelength light. This emitted light is reflected on reflecting sides 208, 210 and 212 and redirected towards indicating surface 206. At the indicating surface, the light is transmitted through the first surfaces of the steps in the indicating surface and becomes visible to an observer positioned opposite the indicating surface. Observers positioned "off axis", that is, not directly opposite the indicating surface, will not be able to view the light.

Thus, a low profile fluorescent indicator light assembly has been described that changes the direction of light coming from an opening in a circuit board by 90 degrees, and redirects this light as a collimated beam in the general direction of the observer's eyes. The lens also filters the white light emitted by the lamp resulting in a single color output.

We claim:

1. An indicator light assembly, comprising in combination:

a translucent block having an index of refraction greater than that of the environment and including a fluorescent material, said block having two opposed and substantially parallel surfaces connected by a plurality of sides;

wherein one of said sides includes an indicating surface positioned at an angle relative to said opposed surfaces whereby internal light traveling substantially parallel to said opposed surfaces is transmitted through said indicating surface; wherein another of said sides includes first and second reflecting surfaces positioned at angles relative to said opposed surfaces whereby internal light traveling substantially parallel to said opposed surfaces is reflected back into said block;

a printed circuit board having a first surface positioned adjacent one of said opposed surfaces of said translucent block, a second surface opposing said first surface, and a hole positioned over said block; and a light source located on said second surface of said printed circuit board and positioned over said hole.

2. An indicator light assembly, comprising in combination:

a translucent block having an index of refraction greater than that of the environment and including a fluorescent material, said block having two opposed and substantially parallel surfaces connected by a plurality of sides;

wherein one of said sides includes a plurality of steps with each step having a first surface substantially perpendicular to said opposed surfaces and a second surface substantially parallel to said opposed surfaces, whereby internal light traveling substantially parallel to said opposed surfaces is transmitted through said first surfaces of said steps; and wherein another of said sides includes first and second reflecting surfaces positioned at angles relative to said opposed surfaces whereby internal light traveling substantially parallel to said opposed surfaces is reflected back into said block.

3. The indicator light assembly of claim 2, further comprising:

a printed circuit board having a first surface positioned adjacent one of said opposed surfaces of said translucent block, a second surface opposing said first surface, and a hole positioned over said block; and a light source located on said second surface of said printed circuit board and positioned over said hole.

4. A low profile indicator light assembly, comprising in combination:

a substantially parallelepiped transparent block having an index of refraction greater than 1.5 and including a fluorescent dye, said block having first and second opposed and substantially parallel surfaces connected by four sides;

wherein one of said sides includes a plurality of steps with each step having a first surface substantially perpendicular to said opposed surfaces and a second surface substantially parallel to said opposed surfaces, whereby internal light traveling substantially parallel to said opposed surfaces is transmitted through said first surfaces of said steps; and wherein three of said sides include first and second reflecting surfaces with said first reflecting surface positioned at an angle of substantially 135 degrees relative to said first opposed surface, and said second reflecting surface positioned at an angle of substantially 135 degrees relative to said second opposed surface, whereby internal light traveling substantially parallel to said opposed surfaces is reflected back into said block.

5. The indicator light assembly of claim 4, further comprising:

a printed circuit board having a first surface positioned adjacent said first opposed surface of said transparent block, a second surface opposing said first surface, and a hole positioned over said block; and a light source connected to said second surface of said printed circuit board and positioned over said hole.

* * * * *

UNITED STATES PATENT AND TRADEMARK OFFICE

CERTIFICATE OF CORRECTION

PATENT NO. : 4,716,501

DATED : December 29, 1987

INVENTOR(S) : John M. McKee et al

It is certified that error appears in the above-identified patent and that said Letters Patent is hereby corrected as shown below:

On the title page Insert

--(73) Assignee: Motorola, Inc., Schaumburg, Ill. --.

Signed and Sealed this

Twenty-seventh Day of September, 1988

*Attest:*

DONALD J. QUIGG

*Attesting Officer*

*Commissioner of Patents and Trademarks*